US009957782B1

(12) United States Patent
Ford

(10) Patent No.: US 9,957,782 B1
(45) Date of Patent: May 1, 2018

(54) SCREEN FILTER ASSEMBLY AND METHOD THEREFOR

(71) Applicant: Michael Brent Ford, St. George, UT (US)

(72) Inventor: Michael Brent Ford, St. George, UT (US)

( * ) Notice: Subject to any disclaimer, the term of this patent is extended or adjusted under 35 U.S.C. 154(b) by 0 days. days.

(21) Appl. No.: 15/376,871

(22) Filed: Dec. 13, 2016

(51) Int. Cl.

| | |
|---|---|
| ***E21B 43/08*** | (2006.01) |
| ***E21B 43/12*** | (2006.01) |
| ***F04B 53/16*** | (2006.01) |
| ***F04B 53/14*** | (2006.01) |
| ***F04B 53/20*** | (2006.01) |

(52) U.S. Cl.
CPC ..... *E21B 43/086* (2013.01); *E21B 43/126* (2013.01); *F04B 53/14* (2013.01); *F04B 53/16* (2013.01); *F04B 53/20* (2013.01)

(58) Field of Classification Search
CPC ..... E21B 43/086; E21B 43/126; F04B 53/20
See application file for complete search history.

(56) References Cited

U.S. PATENT DOCUMENTS

| | | | | |
|---|---|---|---|---|
| 1,548,805 A * | 8/1925 | Mowrey | F04B 53/126 417/554 |
| 6,145,590 A * | 11/2000 | Havard | E21B 43/127 166/105.1 |
| 7,013,979 B2 * | 3/2006 | Richard | E21B 43/086 166/207 |
| 8,858,187 B2 * | 10/2014 | Lane | F04B 47/02 417/53 |
| 2006/0083646 A1 * | 4/2006 | Ford | F04B 53/20 417/555.1 |
| 2011/0079960 A1 * | 4/2011 | Borden | E21B 43/126 277/336 |

* cited by examiner

*Primary Examiner* — Benjamin M Kurtz
(74) *Attorney, Agent, or Firm* — Weiss & Moy, P.C.; Veronica-Adele R. Cao; Karen J. S. Fouts

(57) ABSTRACT

A screen filter assembly is disclosed. The screen filter assembly has an upper screen housing and a lower screen housing, both of which contain screens to filter solids from dirty production fluid. The lower screen housing has a plurality of rings that seal off the area between the upper screen housing and the lower screen housing, thereby preventing any cleaned fluid produced by the lower screen housing from mixing with any contaminated fluid above it. The screen filter assembly filters dirty production fluid in order to keep the solids off of the plunger.

20 Claims, 9 Drawing Sheets

SCREEN FILTER ASSEMBLY AND METHOD THEREFOR

FIELD OF THE INVENTION

The present invention generally relates to oil pumps and standing valves used, therein, and more specifically, to an improved dump valve assembly and related method therefor.

BACKGROUND OF THE INVENTION

In general terms, an oil well pumping system begins with an above-ground pumping unit, which creates the up and down pumping action that moves the oil (or other substance being pumped) out of the ground and into a flow line, from which the oil is taken to a storage tank or other such structure.

Below ground, a shaft is lined with piping known as "tubing." A sucker rod, which is ultimately, indirectly coupled at its north end to the above-ground pumping unit is inserted into the tubing. The sucker rod is coupled at its south end indirectly to the subsurface oil pump itself, which is also located within the tubing, which is sealed at its base to the tubing. The sucker rod couples to the oil pump at a coupling known as a 3-wing cage. The subsurface oil pump has a number of basic components, including a barrel and a plunger. The plunger operates within the barrel, and the barrel, in turn, is positioned within the tubing.

Beginning at the south end, subsurface oil pumps generally include a standing valve, which has a ball therein, the purpose of which is to regulate the passage of oil (or other substance being pumped) from downhole into the pump, allowing the pumped matter to be moved northward out of the system and into the flow line, while preventing the pumped matter from dropping back southward into the hole. Oil is permitted to pass through the standing valve and into the pump by the movement of the ball off of its seat, and oil is prevented from dropping back into the hole by the seating of the ball.

North of the standing valve, coupled to the sucker rod, is a traveling valve. The purpose of a conventional traveling valve is to regulate the passage of oil from within the pump northward in the direction of the flow line, while preventing the pumped oil from slipping back down in the direction of the standing valve and hole.

In use, oil is pumped from a hole through a series of "downstrokes" and "upstrokes" of the oil pump, wherein these motions are imparted by the above-ground pumping unit. During the upstroke, formation pressure causes the ball in the standing valve to move upward, allowing the oil to pass through the standing valve and into the barrel of the oil pump. This oil will be held in place between the standing valve and the traveling valve. In the conventional traveling valve, the ball is located in the seated position. It is held there by the pressure from the oil that has been previously pumped. The oil located above the traveling valve is moved northward in the direction of the 3-wing cage at the end of the oil pump.

During the downstroke, the ball in the conventional traveling valve unseats, permitting the oil that has passed through the standing valve to pass therethrough. Also during the downstroke, the ball in the standing valve seats, preventing the pumped oil from slipping back down into the hole.

The process repeats itself again and again, with oil essentially being moved in stages from the hole, to above the standing valve and in the oil pump, to above the travelling valve and out of the oil pump. As the oil pump fills, the oil passes through the 3-wing cage and into the tubing. As the tubing is filled, the oil passes into the flow line, from which the oil is taken to a storage tank or other such structure.

Fluid that is pumped from the ground is generally impure, and includes solid impurities such as sand, pebbles, limestone, and other sediment and debris. Certain kinds of pumped fluids, such as heavy crude, tend to contain a relatively large amount of solids.

Solid impurities may be harmful to a pumping apparatus and its components for a number of reasons. For example, sand can become trapped between pump components, causing damage, reducing effectiveness, and sometimes requiring a halt to pumping operations and replacement of the damaged component(s). This can be both time consuming and expensive.

The present invention addresses these problems encountered in prior art pumping systems and provides other, related, advantages.

SUMMARY

In accordance with one embodiment, a screen filter assembly for use with a pump system is disclosed. The screen filter assembly comprises: an upper screen housing adapted to be coupled to a southern end of a top plunger adapter, wherein the upper screen housing comprises: a cylindrical body with a center channel formed therethrough; a screen housed within the body of the upper screen housing; and a plurality of apertures extending through the body of the upper screen housing into the center channel of the upper screen housing; a lower screen housing coupled to a southern end of the upper screen housing, wherein the upper screen housing comprises: a cylindrical body with a center channel formed therethrough; a screen housed within the body of the lower screen housing; a plurality of apertures extending through the body of the lower screen housing into the center channel of the lower screen housing; and a plurality of rings coupled to an outer surface of the lower screen housing and positioned above the plurality of apertures of the lower screen housing.

In accordance with another embodiment of a screen filter assembly for use with a pump system is disclosed. The screen filter assembly comprises: an upper screen housing adapted to be coupled to a southern end of a top plunger adapter, wherein the upper screen housing comprises: a cylindrical body with a center channel formed therethrough; a screen housed within the body of the upper screen housing; a plurality of circular flanges formed on an outer surface of the body of the upper screen housing; a plurality of circular grooves formed by and positioned between the circular flanges formed on the outer surface of the body of the upper screen housing; and a plurality of apertures formed within the circular grooves of the upper screen housing and extending through the body of the upper screen housing into the center channel of the upper screen housing; a lower screen housing coupled to a southern end of the upper screen housing, wherein the upper screen housing comprises: a cylindrical body with a center channel formed therethrough; a screen housed within the body of the lower screen housing; a plurality of circular flanges formed on an outer surface of a bottom portion of the lower screen housing; and a plurality of circular grooves formed by and positioned between the circular flanges on the outer surface of the bottom portion of the lower screen housing; a plurality of apertures formed within the circular grooves of the lower screen housing and extending through the body of the lower screen housing into the center channel of the lower screen housing; a plurality of circular grooves formed on an outer surface of a top portion of the lower screen housing; and a plurality of rings configured to fit within the corresponding plurality of circular grooves formed on the outer surface of the top portion of the lower screen housing.

In accordance with another embodiment, a method for removing solids from a pump system is disclosed. The method comprises the steps of: providing a screen filter assembly comprising: an upper screen housing adapted to be coupled to a southern end of a top plunger adapter, wherein the upper screen housing comprises: a cylindrical body with a center channel formed therethrough; a screen housed within the body of the upper screen housing; and a plurality of apertures extending through the body of the upper screen housing into the center channel of the upper screen housing; a lower screen housing coupled to a southern end of the upper screen housing, wherein the upper screen housing comprises: a cylindrical body with a center channel formed therethrough; a screen housed within the body of the lower screen housing; a plurality of apertures extending through the body of the lower screen housing into the center channel of the lower screen housing; and a plurality of cut rings coupled to an outer surface of the lower screen housing and positioned above the plurality of apertures of the lower screen housing; passing dirty pumped fluid upwardly through the lower screen housing during a downstroke; filtering the dirty pumped fluid through the screen housed within the body of the lower screen housing; evacuating clean fluid out of the apertures of the lower screen housing; continuing to pass the dirty pumped fluid upwardly through the upper screen housing during the downstroke; filtering the dirty pumped fluid through the screen housed within the body of the upper screen housing; and evacuating clean fluid out of the apertures of the upper screen housing.

BRIEF DESCRIPTION OF THE DRAWINGS

The present application is further detailed with respect to the following drawings. These figures are not intended to limit the scope of the present application, but rather, illustrate certain attributes thereof.

DETAILED DESCRIPTION OF THE INVENTION

The description set forth below in connection with the appended drawings is intended as a description of presently preferred embodiments of the disclosure and is not intended to represent the only forms in which the present disclosure may be constructed and/or utilized. The description sets forth the functions and the sequence of steps for constructing and operating the disclosure in connection with the illustrated embodiments. It is to be understood, however, that the same or equivalent functions and sequences may be accomplished by different embodiments that are also intended to be encompassed within the spirit and scope of this disclosure.

Figure 1:
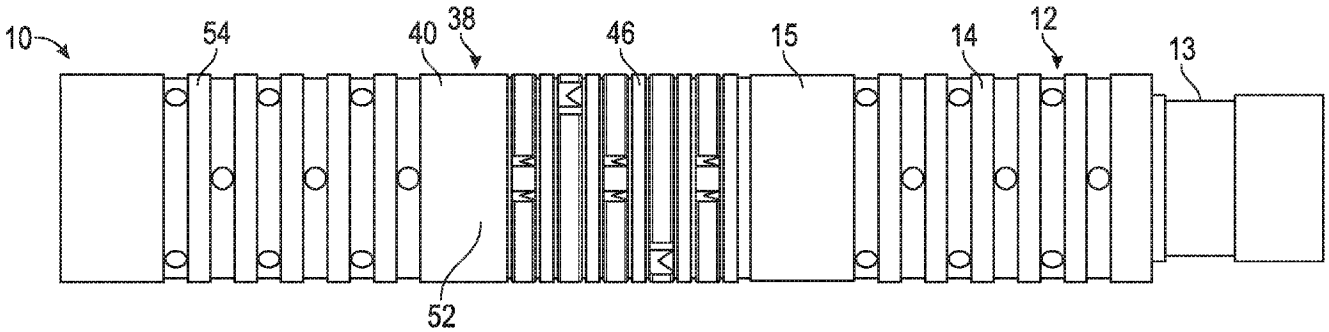
FIG. 1 is a side view of a screen filter assembly in accordance with one or more aspects of the present invention.
Figure 2:
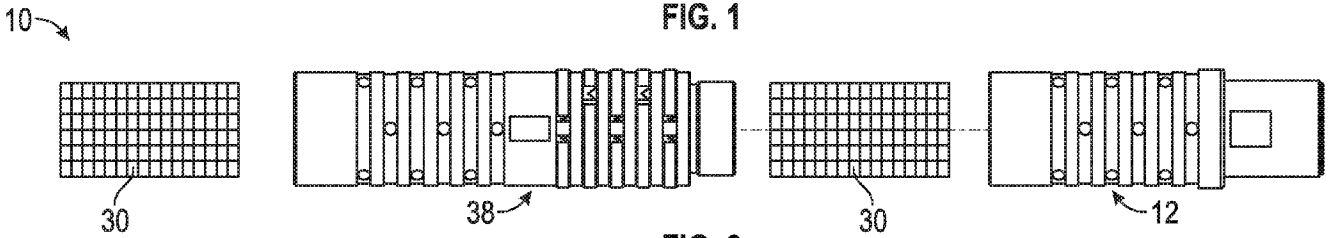
FIG. 2 is a side exploded view of the screen filter assembly of FIG. 1, wherein the screen filter assembly is shown coupled at its north end to a top plunger and coupled at its south end to a plunger.

FIGS. 1-22, together, disclose an embodiment of a screen filter assembly 10 of the present invention. As shown in FIGS. 1-22, the screen filter assembly 10 is adapted to be used with a pump system that is positioned within a pump barrel. Referring to FIGS. 1-2, the screen filter assembly 10 of the present invention may have an upper screen housing 12 and a lower screen housing 38, and a screen 30 positioned in each of the upper screen housing 12 and the lower screen housing 38.

Figure 3:
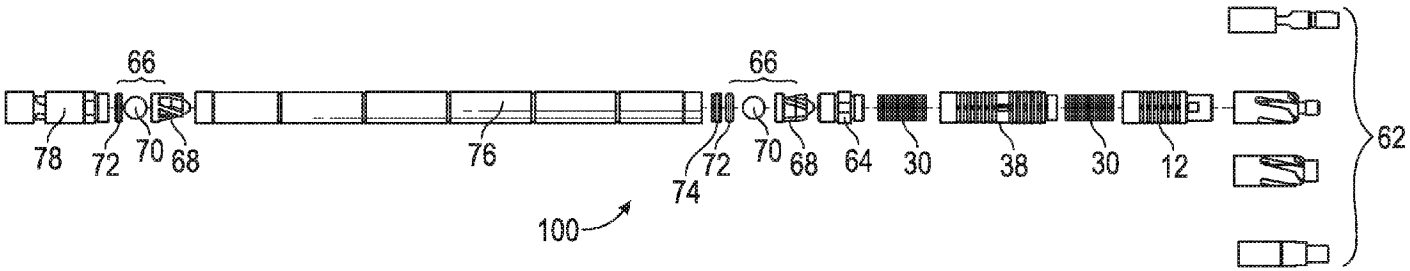
FIG. 3 is a side exploded view of the screen filter assembly of FIG. 1, wherein the screen filter assembly is shown coupled at its north end to a top plunger and coupled at its south end to a plunger.
Figure 4:
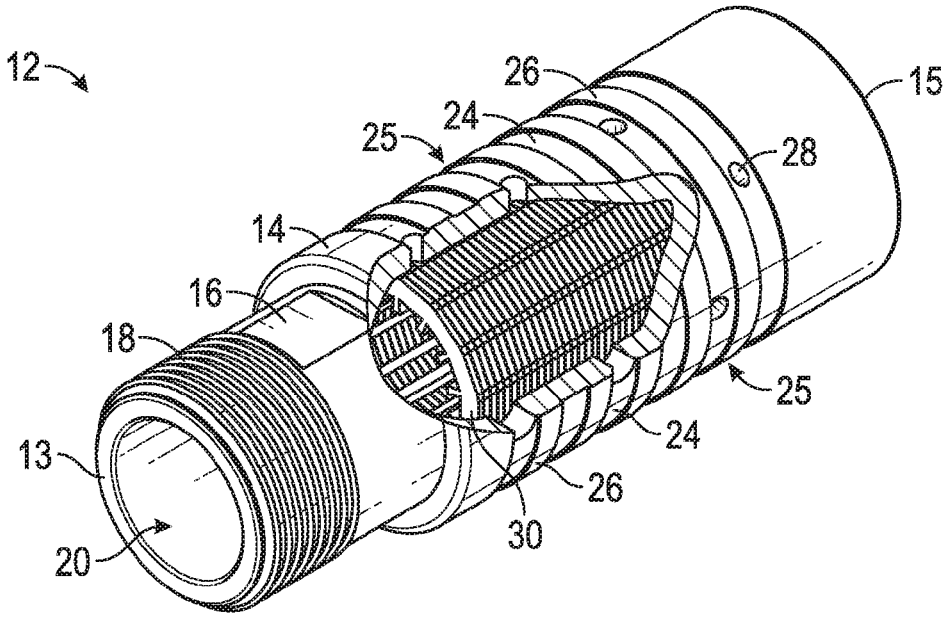
FIG. 4 is a perspective partially cut-away view of an upper screen housing portion of the screen filter assembly of FIG. 1.
Figure 5:
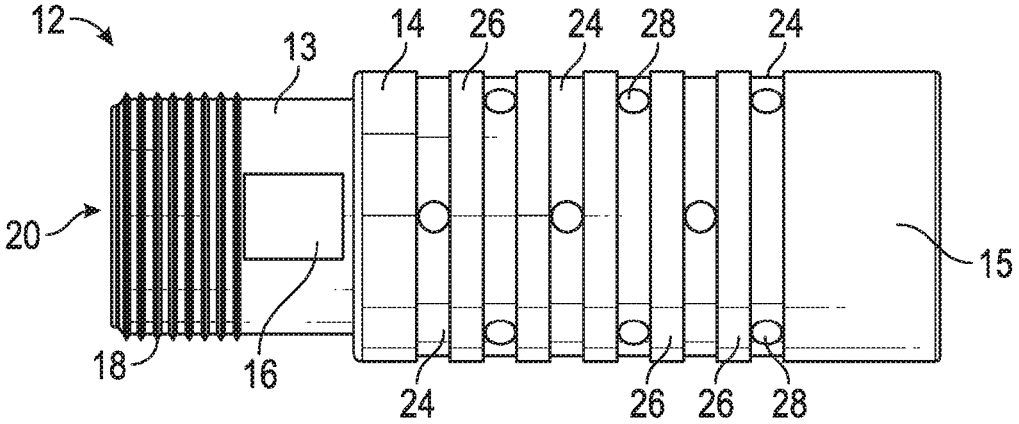
FIG. 5 is a side view of the upper screen housing of FIG. 4.

As shown in FIG. 3, the screen filter assembly 10 may be coupled at its southern end to the northern end of a plunger 76 and the screen filter assembly 10 may be coupled at its northern end to the southern end of any of a number of types of top plunger adapters 62. Here, the screen filter assembly 10 is shown coupled to an adapter 64 which connects the screen filter assembly 10 to a plunger assembly 100 and the plunger assembly 100 comprises a ball valve 66 (made up of a helical insert 68, a ball 70, and a seat 72), a press-fit seat plug 74, a plunger 76, and another ball valve 66 (made up of a helical insert 68, a ball 70, and a seat 72). The southern end of the plunger 76 is shown coupled to the northern end of a traveling valve 78.

FIGS. 4-8 show the upper screen housing 12 of the screen filter assembly 10. The upper screen housing 12 is cylindrical and has a top portion 13 a body 14, a bottom portion 15, and a center channel 20 formed completely therethrough. The top portion 13 of the upper screen housing 12 may have a narrower outer diameter than the body 14 of the upper screen housing 12. The top portion 13 of the upper screen housing 12 may have wrench flats 16 formed thereon and it may also have threading 18 to couple the upper screen housing 12 to a top plunger adapter 62. The bottom portion 15 of the upper screen housing 12 may also have threading 18 to couple the upper screen housing 12 to the lower screen housing 38. The threading 18 may be male or female threading 18, as long as it engages the corresponding male or female threading present on a southern end of the top plunger adapter 62.

The body 14 of the upper screen housing 12 may have a plurality of circular flanges 26 and a plurality of circular grooves 24 formed on its outer surface. Although the upper screen housing 12 is shown as having five circular flanges 26 and six circular grooves 24, it should be clearly understood that any suitable number of circular flanges 26 and grooves 24 may be used. The circular grooves 24 are formed by and are thus positioned between the circular flanges 26. Each circular flange 26 may have a top edge 25 that may be angled downwardly and inwardly toward the center channel 20 of the upper screen housing 12. This downward and inward angle creates a "pocket" or dip that collects solids that are expelled from the center channel 20 of the upper screen housing 12 and out through the apertures 28 formed within the grooves 24. This helps to keep the solids away from the pump barrel. The outer surface of the body 14 may be slightly tapered so that the outer diameters of the circular flanges 26 steadily increase (e.g. by about 0.01 inch) when going from top to bottom. In order words, the circular flange 26 closest to the top portion 13 of the upper screen housing 12 will have the smallest outer diameter and the circular flange 26 closest to the bottom portion 15 of the upper screen housing 12 will have the largest outer diameter.

Figure 6:
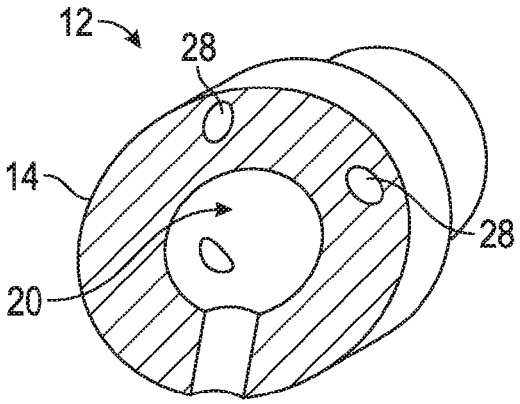
FIG. 6 is a bottom perspective cross-sectional view of the upper screen housing of FIG. 4.
Figure 7:
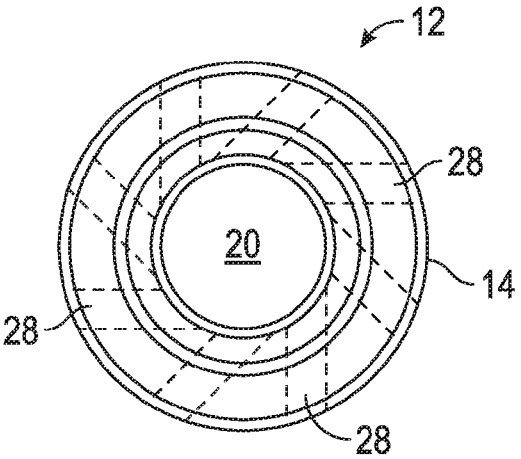
FIG. 7 is a cross-sectional bottom view of the upper screen housing of FIG. 4.

Each circular groove 24 may have a plurality of apertures 28 formed therein. The apertures 28 pass through the body 14 of the upper screen housing 12 and are in fluid communication with the center channel 20 of the upper screen housing 12. Each circular groove 24 can have virtually any number of apertures 28, as can be desired for various well configurations and conditions. In one embodiment, the apertures 28 are evenly spaced around the circular groove 24 on the body 14 of the upper screen housing 12. Preferably, as shown in FIGS. 6-7, from the perspective of the exterior of the upper screen housing 12, each aperture 28 may be angled in a direction that is diagonal to or off-centered from the center channel 20. If the apertures 28 were positioned perpendicularly to the center channel 20, the fluid and solids that are expelled from the apertures 28 would be expelled directly toward the pump barrel, which can cause damage to the pump. Therefore, it is preferable to have the apertures 28 positioned diagonally relative to the center channel 20 (i.e. off-centered) because this allows cyclonic rotation of the fluid and solids that are expelled from the apertures 28 so that they are expelled at an angle and constantly rotated around the upper screen housing 12, thereby preventing the solids from contacting the pump barrel and preventing the solids from accumulating in one particular spot on the top edges 25 of the circular flanges 26.

As shown, the apertures 28 formed in one circular groove 24 may be staggered with the apertures 28 of the circular groove 24 above and/or below it. This aids in the collection and distribution of solids within the pockets or dips of the top edges 25 of the circular flanges 26. If all of the apertures 28 of all of the circular grooves 24 were aligned, this would cause the solids to accumulate in particular spots on the top edges 25 of the circular flanges 26 (in the areas directly below each line of apertures 28), which is not preferable.

Figure 8:
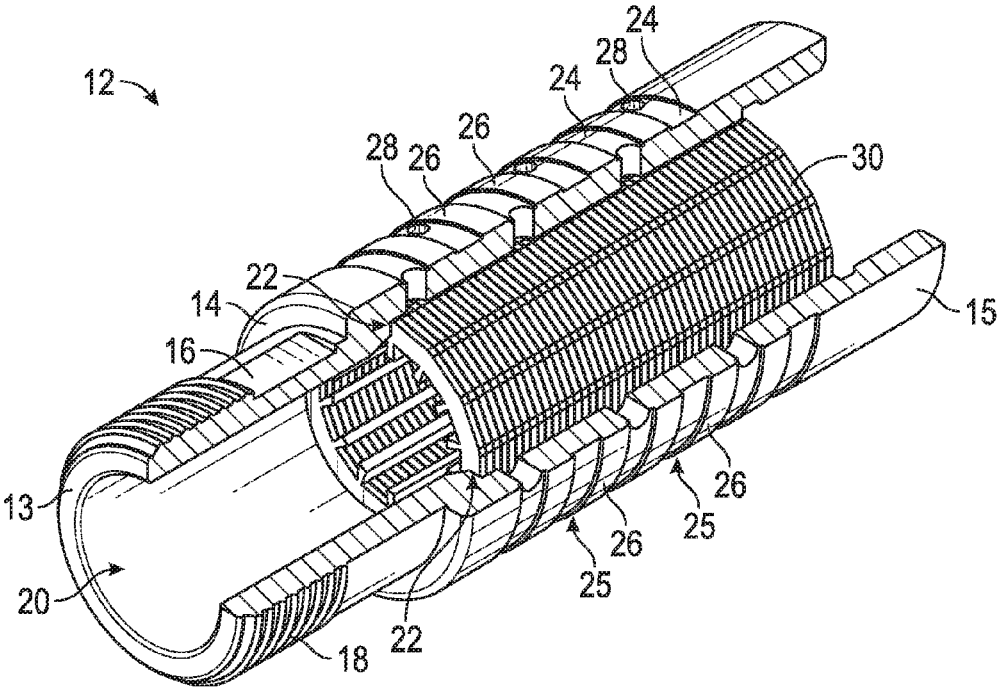
FIG. 8 is a perspective cut-away view of the upper screen housing of FIG. 4 shown with a screen positioned therein.

FIG. 8 is a cross-section of the upper screen housing 12 showing a screen 30 positioned therein. The top portion 13 of the upper screen housing 12 may have a narrower inner diameter than the body 14 of the upper screen housing 12, thereby creating an interior annular flange 22 at the interior junction between the top portion 13 and the body 14 of the upper screen housing 12. This interior annular flange 22 helps to hold the screen 30 in place within the body 14 of the upper screen housing 12. The outer diameter of the screen 30 is slightly smaller than the inner diameter of the body 14 of the upper screen housing 12. The screen 30 (see FIG. 13) has a plurality of coils 32 with spaces 34 formed in between those coils 32. The coil 32 configuration forces the gas within the fluid toward the center of the fluid column, which allows higher density fluid to be available for fluid transfer through the screen 30 and then through the apertures 28 as clean fluid. The spaces 34 between the coils 32 may be approximately 0.004-0.005 inch wide. However the width of the spaces 34 between the coils 32 may vary, depending on the size and type of solids that are present in the particular well. The screen 30 may have a polygonal shape, wherein the outer surface of the screen 30 has multiple straight edges. The polygon shape of the screen 30 allows fluid to accumulate in the area between the screen 30 and the interior surface of the body 14 of the upper screen housing 12, allowing the flow to pass into the apertures 28. If the screen 30 were circular, there would be no space between the outer surface of the screen 30 and the interior surface of the body 14 for fluid to pass; i.e. the apertures 28 would be blocked by the outer surface of the screen 30 if the screen 30 were circular. The open area created by the polygon shape of the screen 30 allows equalization of the fluid to evenly pass into the apertures 28 that has open tolerance between the pump barrel and the apertures 28. In an alternative embodiment, the screen 30 could be circular and simply be made smaller so that it would have a smaller outer diameter, thereby creating the space between the outer surface of the screen 30 and the interior surface of the body 14; however, this would be less efficient because such a smaller screen 30 would limit the amount of fluid that can flow through the upper screen housing 12. The screen 30 may have a plurality of veins 36 formed on the interior surface of the screen 30, which may extend along the full length of the screen 30. As shown, the veins 36 may have a triangular shape. This triangle shape allows for more area flow and less restriction in the flow path of the fluid.

Figure 9:
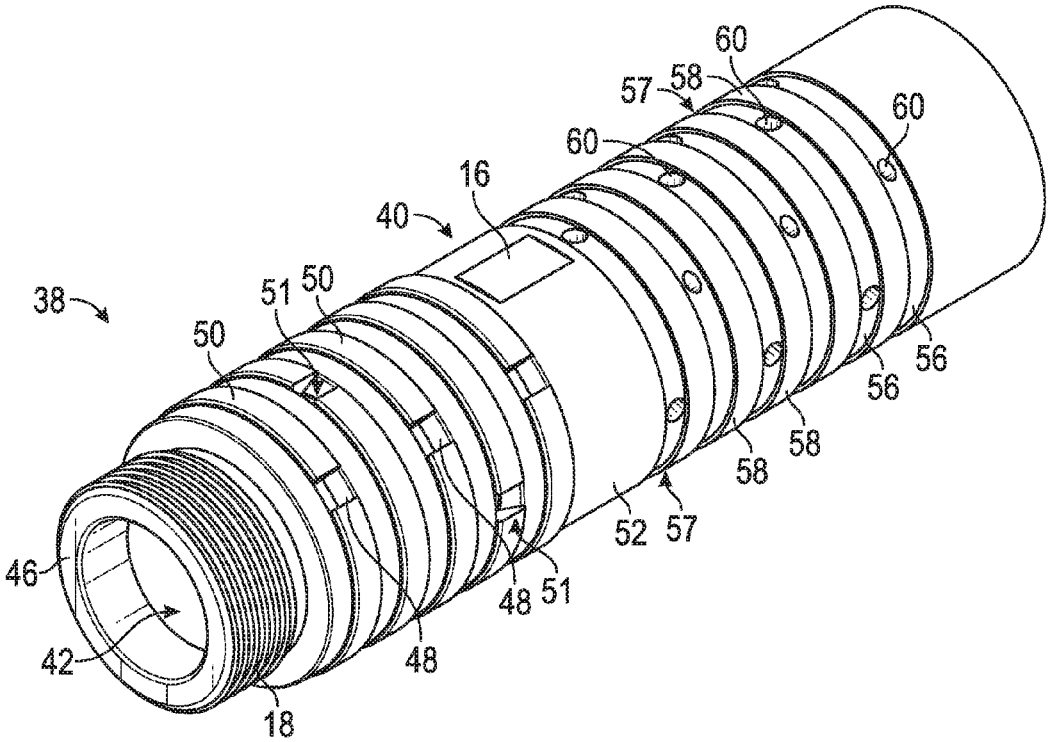
FIG. 9 is a perspective view of a lower screen housing portion of the screen filter assembly of FIG. 1.
Figure 10:
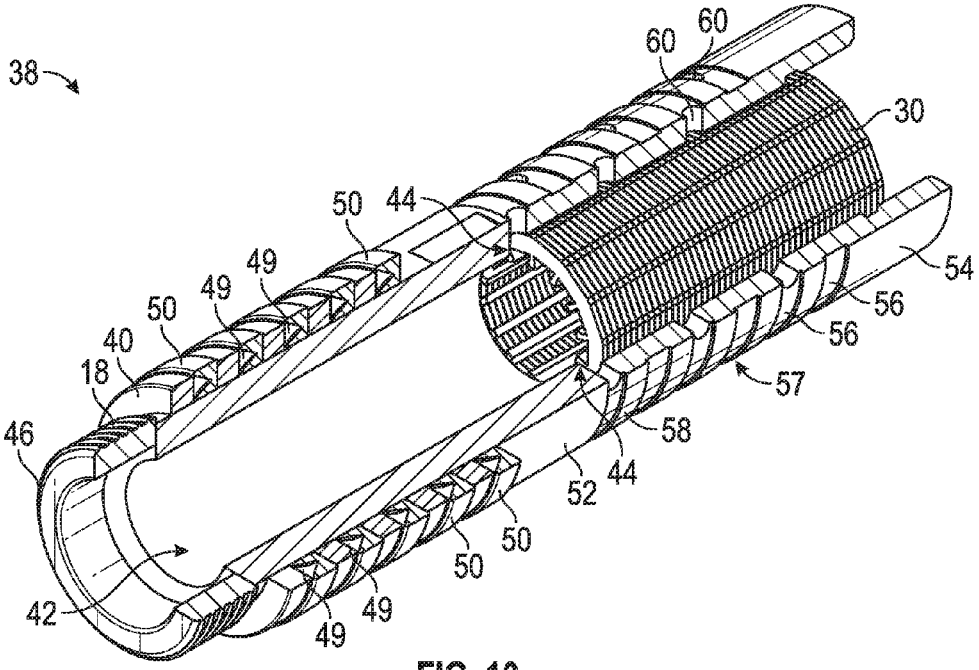
FIG. 10 is a perspective cut-away view of the lower screen housing of FIG. 9 shown with a screen positioned therein.
Figure 11:
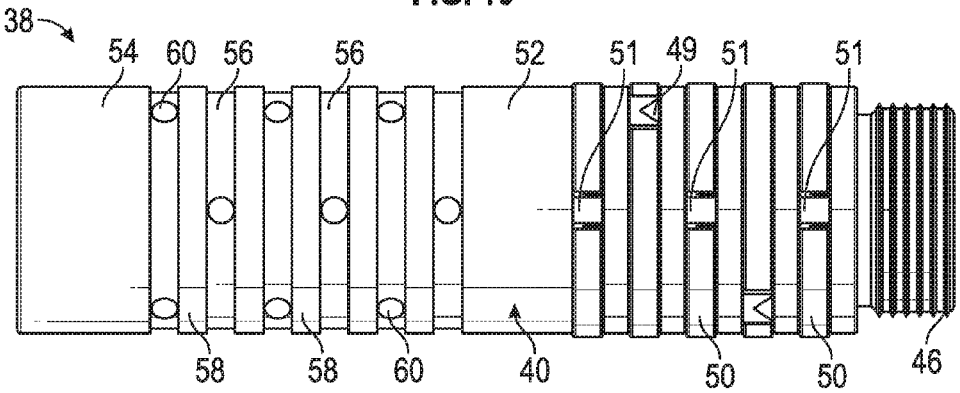
FIG. 11 is a side view of the lower screen housing of FIG. 9.

FIGS. 9-11 show the lower screen housing 38 of screen filter assembly 10. The lower screen housing 38 is cylindrical and has a top portion 46, a body 40, a middle portion 52, a bottom portion 54, and a center channel 42 formed completely therethrough. The middle portion 52 of the lower screen housing 38 may have wrench flats 16 formed thereon. The top portion 46 may have threading 18 to couple the lower screen housing 38 to the southern end of the upper screen housing 12 and the bottom portion 54 may have threading 18 to couple the lower screen housing 38 to the northern end of an adapter 64. The threading 18 may be male or female threading 18, as long as it engages the corresponding male or female threading present on a southern end of the upper screen housing 12 and the northern end of the adapter 64.

Figure 12:
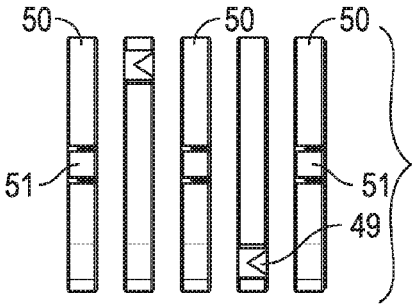
FIG. 12 is a side view of the plurality of rings of the lower screen housing, shown removed from the circular grooves of the top portion of the lower screen housing.
Figure 13:
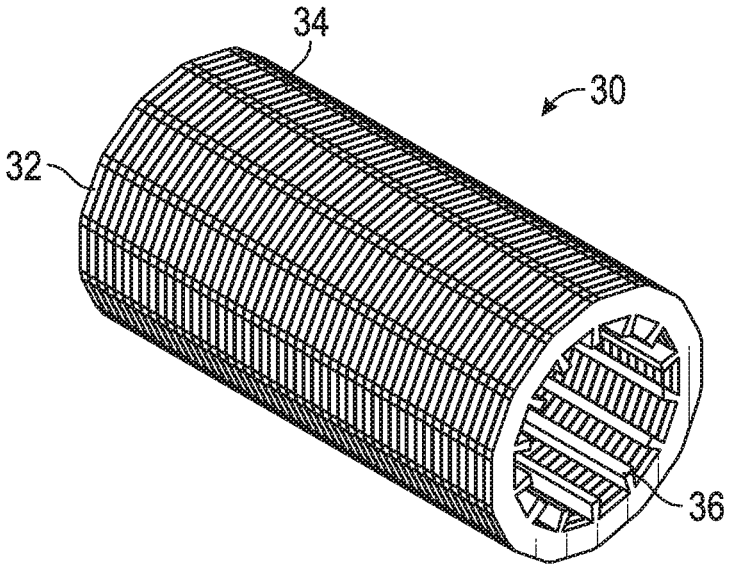
FIG. 13 is a perspective view of the screen used in either the upper screen housing or the lower screen housing.

The top portion 46 of the lower screen housing 38 may have a plurality of circular grooves 48 formed on its outer surface. Although the top portion 46 of the lower screen housing 38 is shown as having five circular grooves 48, it should be clearly understood that any suitable number of circular grooves 48 may be used. The lower screen housing 38 also has a plurality of rings 50 coupled to its outer surface. The rings 50 are configured to fit within the corresponding circular grooves 48. The rings 50 are cut and have a smaller inner diameter than the outer diameter of the circular grooves 48 so that when the rings 50 are placed within the circular grooves 48, there is a small gap 51 between the cut ends of each ring 50. Referring to FIG. 12, the top surface of each ring 50 is not flat; rather, the top surface defines a channel 49. As the screen filter assembly 10 travels upwardly during an upstroke, fluid becomes caught within the channels 49 of the top surfaces of the rings 50. The pressure of the fluid causes the rings 50 to expand outwardly; i.e. the cut ends of each ring 50 separate from each other. This opening/expanding of the rings 50 outwardly against the barrel helps to prevent contaminated solids from falling downward toward the plunger 76. As also shown in FIGS. 9-12, the gaps 51 of the rings 50 are staggered. By having the gaps 51 staggered, any solids that might travel downwardly past the gap 51 of one ring 50 would be caught within the channel 49 of the ring 50 below it.

The bottom portion 54 of the lower screen housing 38 may have a plurality of circular flanges 58 and a plurality of circular grooves 56 formed on its outer surface. Although the bottom portion 54 of the lower screen housing 38 is shown as having five circular flanges 58 and six circular grooves 56, it should be clearly understood that any suitable number of circular flanges 26 and grooves 24 may be used. The circular grooves 56 are formed by and are thus positioned between the circular flanges 58. Each circular flange 58 may have a top edge 57 that may be angled downwardly and inwardly toward the center channel 42 of the lower screen housing 38. This downward and inward angle creates a "pocket" or dip that collects solids that are expelled from the center channel 42 of the lower screen housing 38 and out through the apertures 60 formed within the grooves 56. This helps to keep the solids away from the pump barrel. The outer surface of the bottom portion 54 may be slightly tapered so that the outer diameters of the circular flanges 58 steadily increase (e.g. by about 0.01 inch) when going from top to bottom. In order words, the circular flange 58 closest to the middle portion 52 of the lower screen housing 38 will have the smallest outer diameter and the circular flange 58 closest to the southern end of the bottom portion 54 of the lower screen housing 38 will have the largest outer diameter.

Each circular groove 56 on the bottom portion 54 of the lower screen housing 38 may have a plurality of apertures 60 formed therein. The apertures 60 pass through the bottom portion 54 of the lower screen housing 38 and are in fluid communication with the center channel 42 of the lower screen housing 38. Each circular groove 56 can have virtually any number of apertures 60, as can be desired for various well configurations and conditions. In one embodiment, the apertures 60 are evenly spaced around the circular groove 56 on the bottom portion 54 of the lower screen housing 38. Similar to the apertures 28 of the upper screen housing 12 shown in FIG. 6-7, the lower screen housing 38 also has apertures 60 that are angled in a direction that is diagonal to or off-centered from the center channel 42. This allows cyclonic rotation of the fluid and solids that are expelled from the apertures 60 so that they are expelled at an angle and constantly rotated around the lower screen housing 38, thereby preventing the solids from contacting the pump barrel and preventing the solids from accumulating in one particular spot on the top edges 57 of the circular flanges 58

Figure 14:
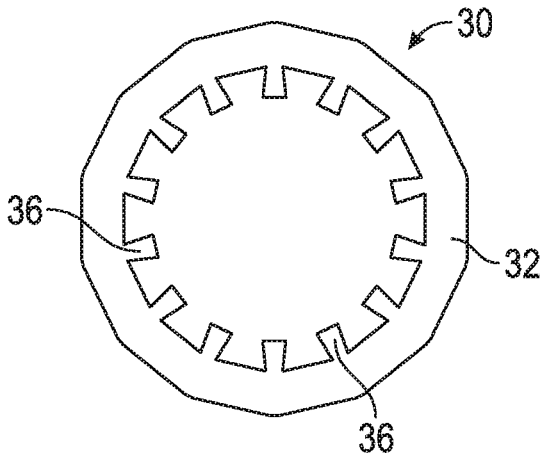
FIG. 14 is a bottom view of the screen of FIG. 13.

Similar to the apertures 28 of the upper screen housing 12, the apertures 60 formed in one circular groove 56 of the lower screen housing 12 may be staggered with the apertures 60 of the circular groove 56 above and/or below it. FIG. 10 is a cross-section of the lower screen housing 38 showing a screen 30 positioned therein. The middle portion 52 of the lower screen housing 38 may have a narrower inner diameter than the bottom portion 54 of the lower screen housing 38, thereby creating an interior annular flange 44 at the interior junction between the middle portion 52 and the bottom portion 54 of the lower screen housing 38. This interior annular flange 44 helps to hold the screen 30 in place within the bottom portion 54 of the lower screen housing 38. Similar to the screen 30 of the upper screen housing 12, the outer diameter of the screen 30 is slightly smaller than the inner diameter of the bottom portion 54 of the lower screen housing 38. The screen 30 (see FIG. 13) has a plurality of coils 32 with spaces 34 formed in between those coils 32. The coil 32 configuration forces the gas within the fluid toward the center of the fluid column, which allows higher density fluid to be available for fluid transfer through the screen 30 and then through the apertures 60 as clean fluid. The spaces 34 between the coils 32 may be approximately 0.004-0.005 inch wide. However the width of the spaces 34 between the coils 32 may vary, depending on the size and type of solids that are present in the particular well. The screen 30 of the lower screen housing 38 may also have a polygonal shape, wherein the outer surface of the screen 30 has multiple straight edges. The polygon shape of the screen 30 allows fluid to accumulate in the area between the screen 30 and the interior surface of the bottom portion 54 of the lower screen housing 38, allowing the flow to pass into the apertures 60. If the screen 30 were circular, there would be no space between the outer surface of the screen 30 and the interior surface of the bottom portion 54 for fluid to pass; i.e. the apertures 60 would be blocked by the outer surface of the screen 30 if the screen 30 were circular. The open area created by the polygon shape of the screen 30 allows equalization of the fluid to evenly pass into the apertures 28 that has open tolerance between the pump barrel and the apertures 60. The screen 30 of the lower screen housing 38 may also have a plurality of veins 36 formed on the interior surface of the screen 30, which may extend along the full length of the screen 30. As shown in FIG. 14, the veins 36 may have a triangular shape. This triangle shape allows for more area flow and less restriction in the flow path of the fluid.

Figure 15:
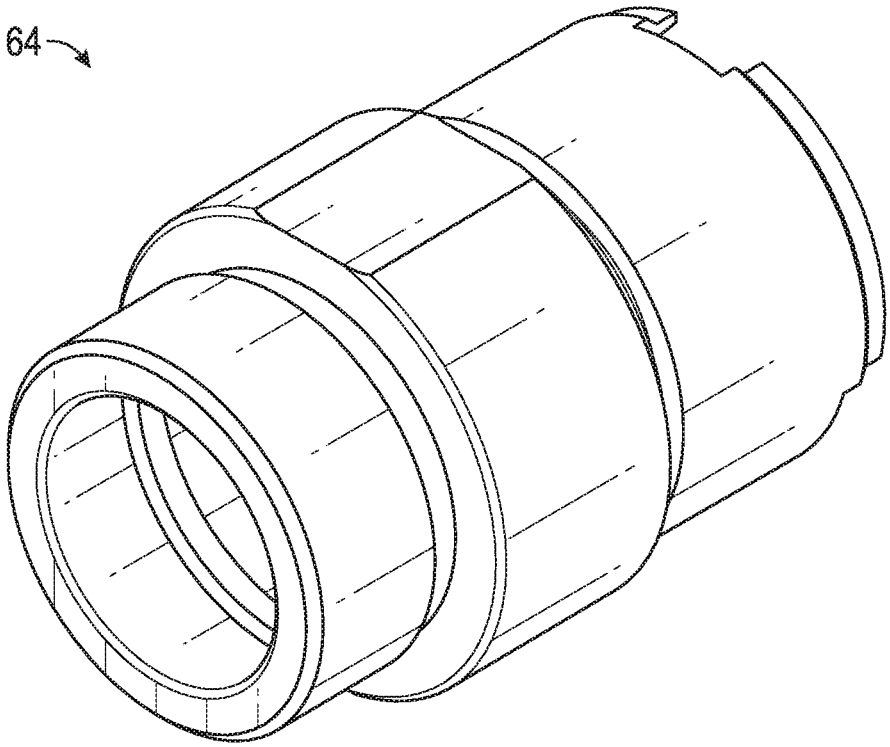
FIG. 15 is a perspective view of an adapter for coupling the screen filter assembly of FIG. 1 to a plunger.
Figure 16:
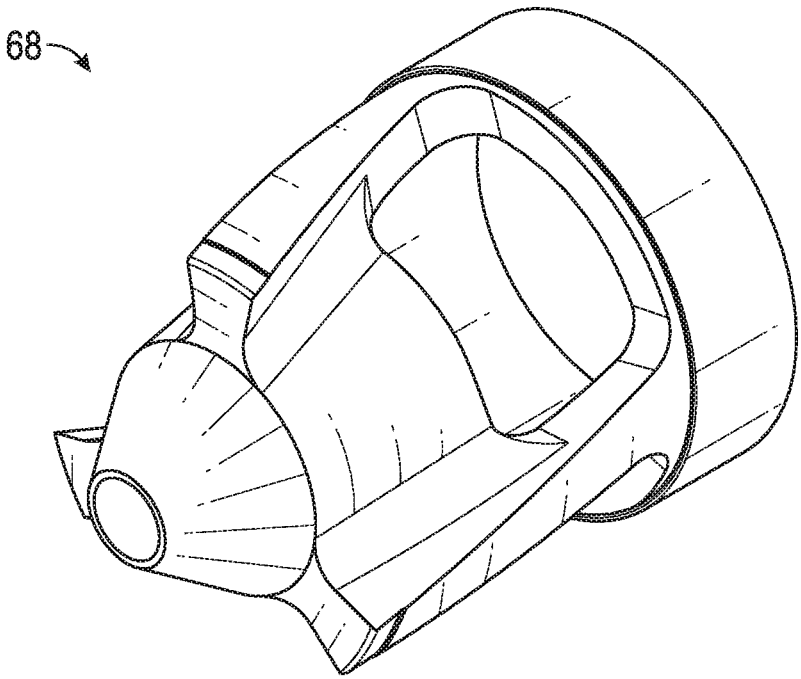
FIG. 16 is a perspective view of an insert portion of a ball valve.
Figure 17:
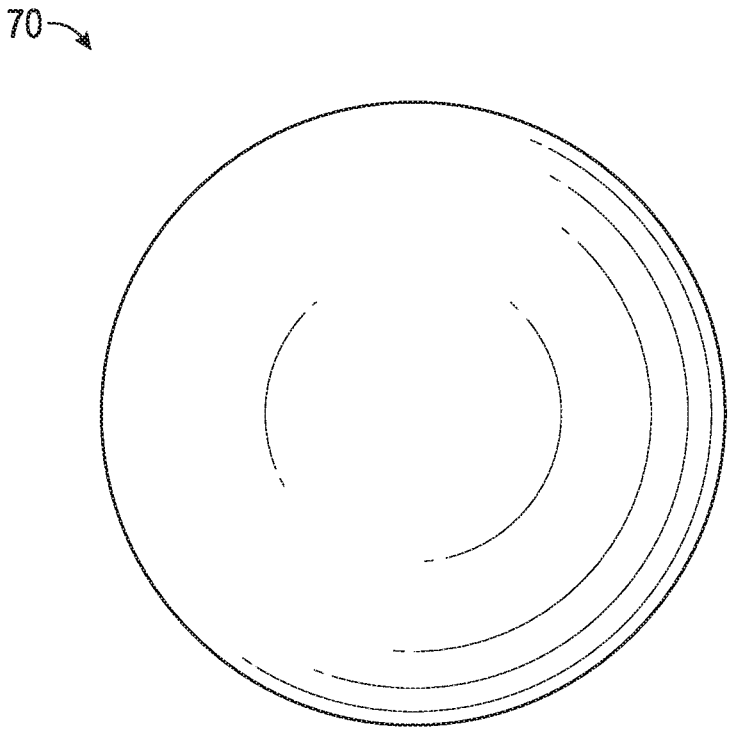
FIG. 17 is a perspective view of a ball portion of a ball valve.
Figure 18:
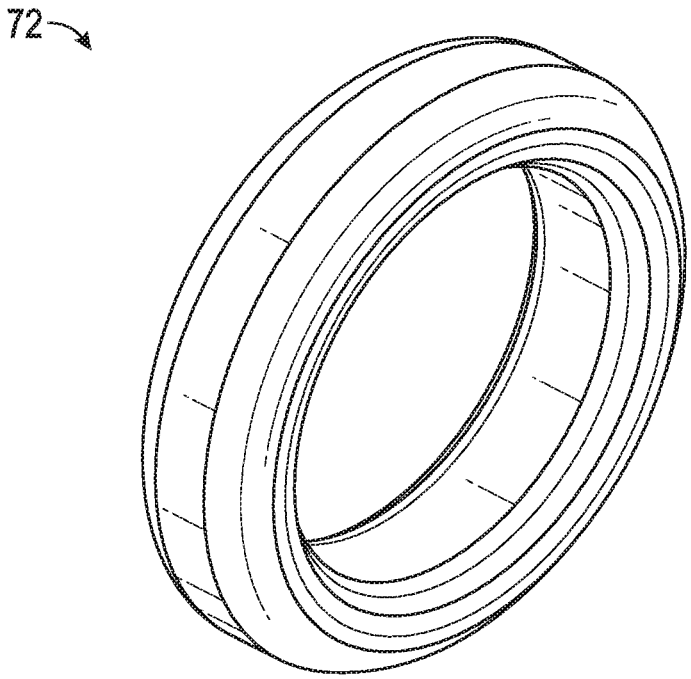
FIG. 18 is a perspective view of a seat portion of a ball valve.
Figure 19:
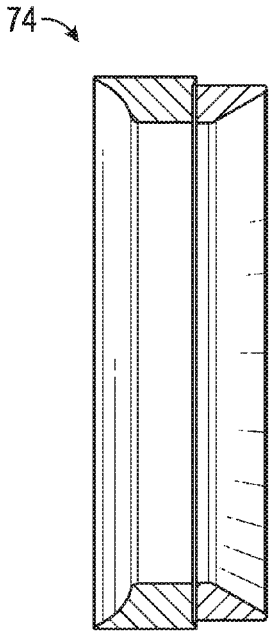
FIG. 19 is a side view of a press-fit seat plug of a plunger.
Figure 20:
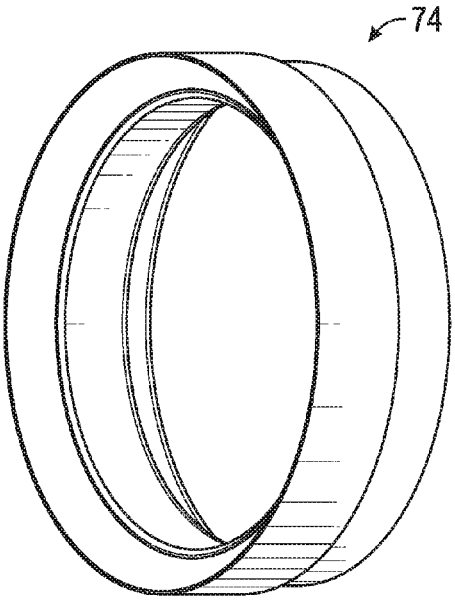
FIG. 20 is a perspective view of the press-fit seat plug of FIG. 19.
Figure 21:
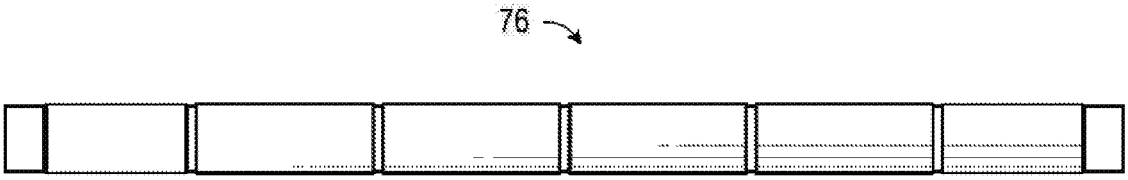
FIG. 21 is a side view of the plunger.
Figure 22:
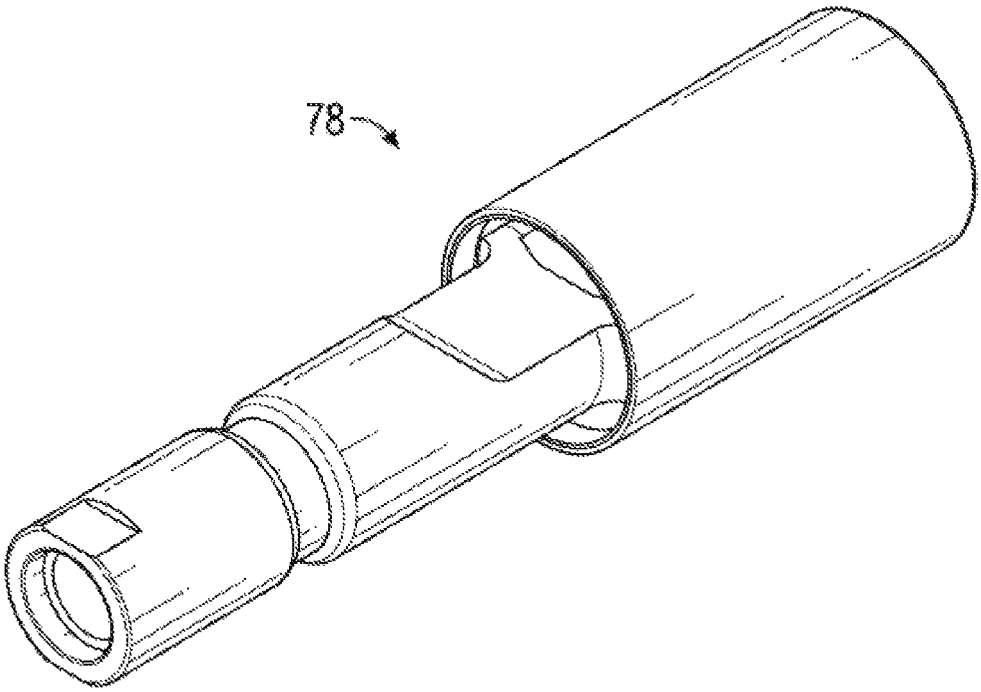
FIG. 22 is a perspective view of a traveling valve assembly.

FIG. 15 shows an adapter 64 for the screen filter assembly 10. The adapter may be used to couple the southern end of the screen filter assembly 10 to the north end of a plunger 76. FIGS. 16-18 together show the portions of a ball valve 66 that may be positioned at the northern end of the plunger 76; i.e. the helical insert 68, the ball 70, and the seat 72. FIGS. 19-20 show the press fit seat plug 74 that would be positioned between the seat 72 of the ball valve 66 and the northern end of the plunger 76. FIG. 21 shows the plunger 76 and FIG. 22 shows the traveling valve 78 that may be coupled to the southern end of the plunger 76. In some embodiments, the ball valve 66 may not be used and the screen filter assembly 10 may be coupled directly to the plunger 76.

Statement of Operation

The screen filter assembly 10 of the present invention may be positioned below a top plunger adapter 62 and above a plunger 76. During a downstroke, dirty fluid enters through the center channel 42 at the bottom portion 54 of the lower screen housing 38 and the pressure of the downstroke pushes the dirty fluid outwardly toward the screen 30 within the lower screen housing 38. As the dirty fluid passes through the screen 30 of the lower screen housing 38, the screen 30 filters the solids from the dirty fluid by preventing any solids larger than the spaces 34 between each coil 32 from passing through the screen 30 toward the apertures 60 of the lower screen housing. The result is that clean fluid is evacuated through the apertures 60 of the lower screen housing 38. The plurality of rings 50 on the top portion 46 of the lower screen housing 38 help to prevent the clean fluid from traveling upwardly and mixing with dirty fluid above the rings 50 near the upper screen housing 12.

Dirty fluid continues to travel upwardly through the lower screen housing 38 and upwardly through the central channel 20 at the bottom portion 15 of the upper screen housing 12. The pressure of the downstroke pushes the dirty fluid outwardly toward the screen 30 within the upper screen housing 12. As the dirty fluid passes through the screen 30 of the upper screen housing 12, the screen 30 filters the solids from the dirty fluid by preventing any solids larger than the spaces 34 between each coil 32 from passing through the screen 30 toward the apertures 60 of the upper screen housing 12. The result is that clean fluid is evacuated through the apertures 28 of the upper screen housing 12.

During an upstroke, fluid becomes caught within the channels 49 of the top surfaces of the rings 50. The pressure of the fluid causes the rings 50 to expand outwardly; i.e. the cut ends of each ring 50 separate from each other. This opening/expanding of the rings 50 outwardly against the barrel helps to prevent any solids that might have been small enough to pass through the spaces 34 of the coils 32 of the screen 30 from falling downward toward the plunger 76. Furthermore, during the upstroke, the rings 50 wipe solids off of the interior of the barrel and collect the solids within the channels 49 of the top surfaces of the rings 50. The filter screen assembly 10 therefore filters the dirty production fluid to help keep the solids off of the plunger 76. By allowing the plunger 76 to move within clean fluid, this helps to prevent wear and tear on the plunger 76.

As mentioned above, the upper screen housing 12 may be coupled to a top plunger adapter 62. In one embodiment, the top plunger adapter 62 may be a collette-style or tubing-style top plunger adapter 62. Preferably, a hollow valve rod will be coupled to a northern end of the top plunger adapter 62. If a hollow valve rod is used, then the top plunger adapter 62 will not have any holes so that all of the dirty fluid will travel upwardly through the hollow valve rod. With a hollow valve rod, all contaminated fluid that passes upwardly through the upper screen housing 12 will continue to travel upwardly through the valve rod and eventually be evacuated about 20-30 feet above the pump. This allows for the presence of completely clean fluid to be present above the rings 50 of the lower screen housing 38. With clean fluid being present below the rings 50 and above the rings 50, this provides completely clean fluid for the pump to work in and eliminates any wear on the plunger 76. The hollow valve rod would continue upwardly through the pump barrel and through a valve rod guide into the 3 wing cage.

Alternatively, a solid valve rod may be used instead of a hollow valve rod. A solid valve rod would exhaust clean fluid that exits the upper screen housing 12, creating a buffer zone from the contaminated fluids that are being exhausted just above the apertures 28 of the upper screen housing 12. This allows for the presence of completely clean fluid to be present above the rings 50 of the lower screen housing 38. With clean fluid being present below the rings 50 and above the rings 50, this provides completely clean fluid for the pump to work in and eliminates any wear on the plunger 76.

The foregoing description is illustrative of particular embodiments of the application, but is not meant to be limitation upon the practice thereof. While embodiments of the disclosure have been described in terms of various specific embodiments, those skilled in the art will recognize that the embodiments of the disclosure may be practiced with modifications within the spirit and scope of the claims.

What is claimed is:

1. A screen filter assembly for use with a pump system comprising:

an upper screen housing adapted to be coupled to a southern end of a top plunger adapter, wherein the upper screen housing comprises:

a cylindrical body with a center channel formed therethrough;

a screen housed within the body of the upper screen housing; and a plurality of apertures extending through the body of the upper screen housing into the center channel of the upper screen housing;

a lower screen housing coupled to a southern end of the upper screen housing, wherein the lower screen housing comprises:

a cylindrical body with a center channel formed therethrough;

a screen housed within the body of the lower screen housing;

a plurality of apertures extending through the body of the lower screen housing into the center channel of the lower screen housing; and a plurality of rings coupled to an outer surface of the lower screen housing and positioned above the plurality of apertures of the lower screen housing, wherein the screen of the upper screen housing and the screen of the lower screen housing each have a polygonal shape, wherein an outer surface of the screen has multiple straight edges.

2. The screen filter assembly of claim 1 wherein the upper screen housing further comprises:

a plurality of circular flanges formed on an outer surface of the body of the upper screen housing; and a plurality of circular grooves formed by and positioned between the circular flanges, wherein the plurality of apertures of the upper screen housing are formed within the circular grooves.

3. The screen filter assembly of claim 2 wherein the outer surface of the body of the upper screen housing is tapered so that the circular flanges have outer diameters that increase when going from top to bottom.

4. The screen filter assembly of claim 2 wherein each circular flange on the outer surface of the body of the upper screen housing has a top edge that is angled downwardly and inwardly toward the center channel of the upper screen housing.

5. The screen filter assembly of claim 2 wherein the plurality of apertures within the circular grooves of the upper screen housing are positioned diagonally to the center channel of the upper screen housing.

6. The screen filter assembly of claim 1 wherein the lower screen housing further comprises:

a plurality of circular flanges formed on an outer surface of a bottom portion of the lower screen housing; and a plurality of circular grooves formed by and positioned between the circular flanges, wherein the plurality of apertures of the lower screen housing are formed within the circular grooves.

7. The screen filter assembly of claim 6 wherein the outer surface of the bottom portion of the lower screen housing is tapered so that the circular flanges have outer diameters that increase when going from top to bottom.

8. The screen filter assembly of claim 6 wherein each circular flange on the outer surface of the bottom portion of the lower screen housing has a top edge that is angled downwardly and inwardly toward the center channel of the upper screen housing.

9. The screen filter assembly of claim 6 wherein the plurality of apertures within the circular grooves of the lower screen housing are positioned diagonally to center channel of the lower screen housing.

10. The screen filter assembly of claim 6 wherein the lower screen housing further comprises a plurality of circular grooves formed on an outer surface of a top portion of the lower screen housing wherein the plurality of rings of the lower screen housing are configured to fit within the corresponding plurality of circular grooves.

11. The screen filter assembly of claim 10 wherein each ring is cut and has a smaller inner diameter than an outside diameter of its corresponding circular groove of the top portion of the lower screen housing so that when the ring is placed within the circular groove of the top portion of the lower screen housing, a gap is created between two cut ends of the ring.

12. The screen filter assembly of claim 11 wherein the gap of one ring is staggered with a gap of an adjacent ring.

13. The screen filter assembly of claim 1 further comprising a plurality of veins formed on an interior surface of each of the screen of the upper screen housing and the screen of the lower screen housing.

14. The screen filter assembly of claim 13 wherein the veins have a triangular shape.

15. A screen filter assembly for use with a pump system comprising:

an upper screen housing adapted to be coupled to a southern end of a top plunger adapter, wherein the upper screen housing comprises:

a cylindrical body with a center channel formed therethrough;

a screen housed within the body of the upper screen housing;

a plurality of circular flanges formed on an outer surface of the body of the upper screen housing;

a plurality of circular grooves formed by and positioned between the circular flanges formed on the outer surface of the body of the upper screen housing; and a plurality of apertures formed within the circular grooves of the upper screen housing and extending through the body of the upper screen housing into the center channel of the upper screen housing;

a lower screen housing coupled to a southern end of the upper screen housing, wherein the lower screen housing comprises:

a cylindrical body with a center channel formed therethrough;

a screen housed within the body of the lower screen housing;

a plurality of circular flanges formed on an outer surface of a bottom portion of the lower screen housing; and a plurality of circular grooves formed by and positioned between the circular flanges on the outer surface of the bottom portion of the lower screen housing;

a plurality of apertures formed within the circular grooves of the lower screen housing and extending through the body of the lower screen housing into the center channel of the lower screen housing;

a plurality of circular grooves formed on an outer surface of a top portion of the lower screen housing; and a plurality of rings configured to fit within the corresponding plurality of circular grooves formed on the outer surface of the top portion of the lower screen housing, wherein the screen of the upper screen housing and the screen of the lower screen housing each have a polygonal shape, wherein an outer surface of the screen has multiple straight edges.

16. The screen filter assembly of claim 15 wherein each ring is cut and has a smaller inner diameter than an outside diameter of its corresponding circular groove of the top portion of the lower screen housing so that when the ring is placed within the circular groove of the top portion of the lower screen housing, a gap is created between two cut ends of the ring.

17. The screen filter assembly of claim 15 wherein the plurality of apertures within the circular grooves on the outer surface of the body of the upper screen housing are positioned diagonally to the center channel of the upper screen housing and the plurality of apertures within the grooves on the outer surface of the bottom portion of the lower screen housing lower are positioned diagonally to the center channel of the lower screen housing.

18. A method for filtering solids within a pump barrel of a pump system comprising the steps of:

providing a screen filter assembly comprising:

an upper screen housing adapted to be coupled to a southern end of a top plunger adapter, wherein the upper screen housing comprises:

a cylindrical body with a center channel formed therethrough;

a screen housed within the body of the upper screen housing; and a plurality of apertures extending through the body of the upper screen housing into the center channel of the upper screen housing;

a lower screen housing coupled to a southern end of the upper screen housing, wherein the lower screen housing comprises:

a cylindrical body with a center channel formed therethrough;

a screen housed within the body of the lower screen housing;

a plurality of apertures extending through the body of the lower screen housing into the center channel of the lower screen housing; and a plurality of cut rings coupled to an outer surface of the lower screen housing and positioned above the plurality of apertures of the lower screen housing;

wherein the screen of the upper screen housing and the screen of the lower screen housing each have a polygonal shape, wherein an outer surface of the screen has multiple straight edges;

passing dirty pumped fluid upwardly through the lower screen housing during a downstroke;

filtering the dirty pumped fluid through the screen housed within the body of the lower screen housing;

evacuating clean fluid out of the apertures of the lower screen housing;

continuing to pass the dirty pumped fluid upwardly through the upper screen housing during the downstroke;

filtering the dirty pumped fluid through the screen housed within the body of the upper screen housing; and evacuating clean fluid out of the apertures of the upper screen housing.

19. The method of claim 18 further comprising the step of expanding of the cut rings on the outer surface of the lower screen housing outwardly against the pump barrel during an upstroke to prevent any solids that might have been small enough to pass through the screens from falling downward toward a plunger coupled to a southern end of the screen filter assembly.

20. A screen filter assembly for use with a pump system comprising:

an upper screen housing adapted to be coupled to a southern end of a top plunger adapter, wherein the upper screen housing comprises:

a cylindrical body with a center channel formed therethrough;

a screen housed within the body of the upper screen housing; and a plurality of apertures extending through the body of the upper screen housing into the center channel of the upper screen housing;

a lower screen housing coupled to a southern end of the upper screen housing, wherein the lower screen housing comprises:

a cylindrical body with a center channel formed therethrough;

a screen housed within the body of the lower screen housing;

a plurality of apertures extending through the body of the lower screen housing into the center channel of the lower screen housing; and a plurality of rings coupled to an outer surface of the lower screen housing and positioned above the plurality of apertures of the lower screen housing; and a plurality of veins formed on an interior surface of each of the screen of the upper screen housing and the screen of the lower screen housing.

* * * * *